United States Patent [19]

Leistritz

[11] Patent Number: 5,003,775

[45] Date of Patent: Apr. 2, 1991

[54] SELF-SUCTIONING PISTON ENGINES

[76] Inventor: Hans K. Leistritz, Am Schroffen 8, D-7596 Seebach, Fed. Rep. of Germany

[21] Appl. No.: 325,993

[22] Filed: Mar. 20, 1989

[30] Foreign Application Priority Data

Mar. 18, 1988 [DE] Fed. Rep. of Germany ..... 3905405

[51] Int. Cl.[5] ..... F02B 27/02

[52] U.S. Cl. ..... 60/313; 60/323

[58] Field of Search ..... 60/312, 313, 314, 323

[56] References Cited

U.S. PATENT DOCUMENTS 3,813,880 6/1974 Reid ..... 60/314
4,226,298 10/1980 Bancel ..... 60/314

FOREIGN PATENT DOCUMENTS 737396 7/1943 Fed. Rep. of Germany ..... 60/313
3501337 7/1986 Fed. Rep. of Germany ..... 60/312
3523853A1 1/1987 Fed. Rep. of Germany .
3809123.2 3/1988 Fed. Rep. of Germany .
3700182A1 6/1988 Fed. Rep. of Germany .
3707778 9/1988 Fed. Rep. of Germany ..... 60/312

*Primary Examiner*—Douglas Hart
*Attorney, Agent, or Firm*—Watson Cole Grindle & Watson

[57] ABSTRACT

Self-suctioning apparatus for multi-cylinder piston engines uses a tube-like pipe system extending from the manifold of the engine and includes a diverter for dividing the waste gas stream into several partial streams with the diverted waste gas streams being reflected and focused on an inner wall of the pipe system to form a zone of hot waste gases which are received by a nozzle system with no waste gas flow reversal to provide an uninterrupted suctioning effect and a continuous gas flow with a higher degree of air charging and an exit tube receiving the continuous gas flow for discharge into the ambient.

4 Claims, 1 Drawing Sheet

SELF-SUCTIONING PISTON ENGINES

BACKGROUND OF THE INVENTION

1. Field of the Invention

The invention is directed toward improved operation of self-suctioning piston engines, and in particular to the abrupt discharge of waste gas in multi-cylinder engines to enlarge the degree of air charge to so far not attainable levels in all engine combustion chambers within the introduced fuel/air mixture to obtain engine operation with low level noxious substances and considerable increase in engine output with simultaneous reduction of the fuel dosage elements.

2. Related Art

The maturity of piston engine engineering has been blocked by the fact that it has not been possible to sufficiently increase, in charging the engine combustion area, the fuel-air mixture with regard to the air charging degree only by means of gas exchange. It is a fixed notion in the field of expert knowledge that it does not help to simply feed the combustion chamber greater amounts of fuel: for the purpose of maintaining the mixture ratio it is also necessary to supply a corresponding amount of air, which is much more difficult and the task of gas exchange". (Wilhelm Endres; "Verbrennungsmotoren"; Volume I, page 17).

The various known devices for solving the problem of air charging were also not able to assert themselves, apart from the added costs; they retained the self-suction system integrated into the most common piston engine which, however, included the defect to only be able to offer limited air charging. By the fact that the present technology for the first time appreciably surpassed these air intake limits and thus considerably lowered the noxious matter accumulation as well as substantially raised the engine output, the applicant sees the starting solution of an inescapable problem in the scale of world marketing, in view of the air pollution as perceived today; as the multi-cylinder piston engine depends in particular, with its annually increasing production numbers, without fail on the fact that it becomes ecologically perfect. The manner in which this has been attained can be recognized by the present invention, as a measure which simultaneously removes a problem which has occupied engine construction incessantly since Otto and Diesel: it is the manner in which air is fed in, because this is not possible just with a "depletion" of the mixture, thus the mere increase of the share of air, as then, as expressed by Wilhelm Endres, in the mixture loaded with excess air in the engine combustion chamber "too many particles unable to be burned would lie as ballast between the combustible particles". The consequence is that the adjustment procedure has to be retained, with which for example, the carburetor retains at all charging levels of the engine the mixture ratio near Lambda 1, which applies for all engine combustion chambers of a serial engine. This adjustment procedure is dependent on the fact that the reaction chain of the self-suction procedure is retained and does not suffer any energy losses either on the suction side or on the waste gas side.

SUMMARY OF THE INVENTION

This can be solved, according to the present invention, by the fact that: (a) there is per engine cylinder an abrupt discharge tied to the time phase of the gas exchange of the individual cylinders, and (b) it s discharge into the collected volume, executed in a propelling nozzle fashion occurs abruptly, and that (c) changes again in a propelling nozzle fashion into the long tube adjusted to the correct cross section. In such a construction sequence the increased air supply takes place within the suction system, due to this double abrupt discharge, which is necessary for the complete combustion in the combustion chambers of the multi-cylinder and which can be exactly adjusted according to the operational status by means of the double flap system.

The "abrupt discharge" which is relied upon here, has been defined by the applicant in P 37 00 182.5 as a piston distance discharge system, which can show the reinforced potential for a piston engine charging process to the extent that it reinforces the suction output in such a manner that the test stand adjustment makes possible, already starting with a cold engine start, charges producing waste gas emissions practically free of noxious matter by means of the new design of the fuel and air dosing devices and accompanying measures which do not affect the output, whereby the current serial design, to near the fixed misfire limit produces high levels of noxious matter content in the waste gas. This phenomenon has also been shown constructively in connection with differentiating divergence/convergence in P 35 23 853, either as a breakdown of the discharge by means of a nozzle pipe formed into a number of gas jets, which is designated as convergence, is brought into focus or as a formation of various condensation pulses by means of slanted walls and then also focused.

Both types of focusing have since then been used as guidance in the constructions of the applicant, and it has been recognized for both that such dynamics can only be obtained from such condensation pulses which result from the piston distance, undiminished in energy. Both types of focusing are assumed to be attained state of the art for this application. P 38 09 123.2 clearly states "to form" the construction of the resulting propelling nozzle convergence volume in the general part of its principal claim from the quality of the tube distances of the multi-cylinder piston distance discharge, "including thermal energy by means of slanted surface reflection of the preceding pressure wave in focusing flow distances for the purpose of final combustion" and to simultaneously increase the subsequent suction effect by a ram jet type space geometry for improving the charge. Both phenomena of which the fact is so well known in the field that it is no longer doubted as an explanation for increasing the engine output. For this reason it is no surprise that with the construction according to FIG. 1, the expected output increase also took place. Therefore, both types of condensation pulse are protected for the input tubes 323(1) to 323(4).

BRIEF DESCRIPTION OF THE DRAWINGS

The above objects, features and advantages of the invention are readily apparent from a consideration of the following description of preferred embodiments representing the best mode of carrying out the invention when considered in conjunction with the drawings, wherein.

DETAILED DESCRIPTION

Figure 1:
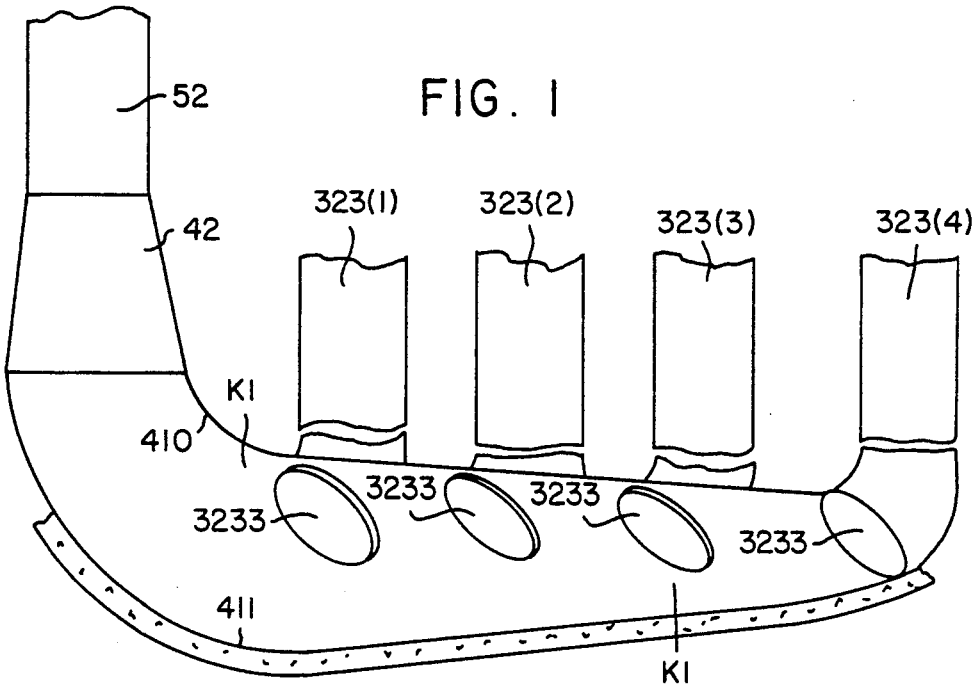
FIG. 1 is an embodiment of an exhaust gas system for a multi-cylinder piston engine in accordance with the invention.

The multi-cylinder propelling nozzle according to FIG. 1 has been described in detail in P 38 09 123.3. It contains, according to the ignition sequence in which the multi-cylinder engine is arranged, on its increasingly widening lengthwise extension, so-called abrupt discharge openings 3233 per cylinder directed towards the opposing slanted wall 411, which are brought by this in the inside space of the nozzle K1 into a full effective degree of their displacement energy with which the downstream part of this inside space K1 is filled, which is constructed, first in expanded shape, straight or with a bent tube. The subsequent even, conical, narrowing portion 42 passes into a long tube 52, designed in agreement with the increase of engine output, for which there are special conditions in the bottom groups of the motor vehicles and which, after bypassing the rear axle, ends in a final muffler group. The openings 3233 extend only insubstantially or not at all into the inside space K1. The inside walls 410/411 of the space K1 are designated as waveguide walls in P38 09 123.2, in order to express the fact that this has to be waveguide quality without loss of energy (the term "waveguide" comes from the lines in which loss free wave expansion is essential), in which losses of impulse energy, as they are usually intended in engine waste gas lines, clearly have to be prevented. The oscillation share resulting from the openings 3233 is to be retained as it intensively promotes all subsequent reactions for which the chemical conditions are present in the waste gas, particularly in the case of heat accumulation.

The double flap system of the suction side regulates the energetically high discharge system of the piston engine from cold start in such a manner that already during the warm-up phase the CO and HC ranges of the attainable minimum values can be attained, which, given the correct adjustment, can be maintained through all operational phases and do not reduce the engine output, but however, the there discharged energy losses of the engine charge, because the new procedure makes it possible to proceed to essentially smaller fuel dosages on the suction side. While the engine adjustment of the current state of the art discharges usually between 2 and 5 percent by volume of CO values during warm up as well as during all high charge conditions of, for example, the Otto engine, now also there extreme reductions of the CO discharge within a range of between 0.03 and 0.3% are possible. It is of importance that this is not attained by means of added devices such as catalyzers or thermal reactors, and also does not require either a later additional air intake, or spark ignition within the waste gas installation, but represents the consequence of a technologically newly arranged gas exchange flow rate in the whole area suction side/engine combustion chamber/waste gas side.

The new technology, already patented, of the piston engine gas exchange process increases in the scavenging system of the Otto motor the air charge degree within all engine combustion chamber charges fuel/air quantity by means of energetically new adjustment of the whole pipe system. The results are not only clean engine waste gases, but also the possibility to attain improved engine output due to the avoidance of former energy losses.

Figure 2:
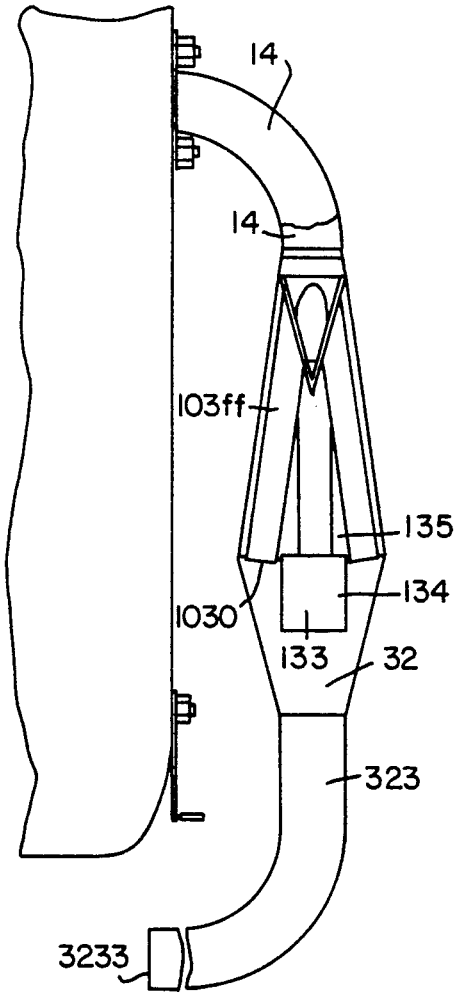
FIG. 2 is a modification of each of the inlet exhaust gas lines for the embodiment of FIG. 1.

The multi-cylinder engine with ejection of the individual cylinder as illustrated in FIG. 2 shows a waste gas distance within a tube-like pipe system 14/323 not mixed with the other cylinder ejections; about in the center of this pipe distance 14/323 there is a division of the waste gas stream into several identical partial streams by means of a pipe cluster 103 ff or in another manner, which by means of reflection on the inner wall of the sequential space 32 form a hot zone in a focusing manner and continue in the time phase of the gas exchange process with this temperature increase in the downstream part 323 of the pipe distance. All pipe distances 13/323 of the individual cylinders reach with their openings 3233 a nozzle system combining all waste gases, according to FIG. 1, which including the long pipe 52 into which it opens, is part of a pipe distance in which, from the engine flange zone there is no flow reversal due to slanted walls and represents a flow continuum with an uninterrupted suctioning effect within the self suctioning segments of all types with higher degree of air charging, which in spite of reduced fuel dosing provides a higher engine output and decreases former energy losses.

The nozzle system of FIG. 1, according to P 38 09 123.2, changes engine from a smallest cross section within the zone in which the openings 3233 in FIGS. 1 and 2 of the individual cylinders are directed, into an even largest cross section zone K1 which has no sudden space change and whose transition into the long tube 52 contains a very gradual narrowing degree which can follow along with the there occurring speed increase without energy loss with an increase of stress and rotation numbers.

The long tube 52 in coordination for the purpose of maintaining the output increase which is shown by the open tube measuring, even after the transition into a sound damping final element in two steps in such a manner that from the downstream part of the space K1 through the narrowing zone 42 the entry into a first long tube extension with such a cross section dimension is determined which can support, in the subsequent long tube section a cross section dimension, selectable according to a similar narrowing zone 42, reduced by about half.

The sizing of the nozzle with regard to its increase in cross section is done such that its upstream cross section conforms to a tube diameter 323/4, double at the second tube inlet 323/3 and triple at the third 323/2 and so on.

What is claimed is:

1. Apparatus for the discharge of waste gases in multicylinder piston engines, comprising:

an exhaust path of a tubular line shape for maintaining separate the discharge of each of the individual cylinders of the multicylinder piston engine, each exhaust path including an outlet;

an exhaust nozzle with an end portion formed by one of the outlets and sloping walls diverging from said end portion to another end portion terminating in a conical narrowing portion and the remainder of said outlets being spaced along the longitudinal axis of said exhaust nozzle extending between said end portions; and and a pipe interconnecting said conical narrowing portion, and a muffler.

2. Apparatus as claimed in claim 1, wherein the cross section of said exhaust nozzle at the outlet immediately adjacent said one outlet is twice that of the cross section at said one outlet, the cross section of the next adjacent outlet is three times the cross section of said one outlet and the cross section of said exhaust nozzle keeps increasing in the same ratio for the remaining outlets.

3. Apparatus as claimed in claim 1, wherein each of the exhaust paths includes a bundle of pipes for diverting the exhaust gas stream and a chamber downstream of said bundle of pipes and having converging walls and positioned such that the diverted exhaust gases from said bundle of pipes are focused by reflection on said converging walls to increase the temperature of said exhaust gases.

4. Apparatus as claimed in claim 2, wherein each of the exhaust paths includes a bundle of pipes for diverting the exhaust gas stream and a chamber downstream of said bundle of pipes and having converging walls and positioned such that the diverted exhaust gases from said bundle of pipes are focused by reflection on said converging walls to increase the temperature of said exhaust gases.

* * * * *